US006213868B1

(12) United States Patent
Sells

(10) Patent No.: US 6,213,868 B1
(45) Date of Patent: Apr. 10, 2001

(54) ROOF VENTILATOR WITH MOVABLE MEMBER TO PREVENT ENTRY OF MOISTURE

(75) Inventor: Gary L. Sells, Mishawaka, IN (US)

(73) Assignee: Cor-A-Vent, Inc., Mishawaka, IN (US)

( * ) Notice: Subject to any disclaimer, the term of this patent is extended or adjusted under 35 U.S.C. 154(b) by 0 days.

(21) Appl. No.: 09/351,021

(22) Filed: Jul. 12, 1999

(51) Int. Cl.[7] ..... F24F 7/02
(52) U.S. Cl. ..... 454/359; 52/199; 454/365
(58) Field of Search ..... 454/259, 353, 454/359, 364, 365, 358, 360, 361, 363; 52/199

(56) References Cited

U.S. PATENT DOCUMENTS

| | | | | |
|---|---|---|---|---|
| 1,547,974 | * | 7/1925 | Thaw | 454/359 |
| 1,897,440 | | 2/1933 | Richardson . | |
| 3,403,616 | | 10/1968 | Nelson . | |
| 4,325,290 | | 4/1982 | Wolfert . | |
| 4,399,738 | | 8/1983 | Sharkey . | |
| 4,624,176 | | 11/1986 | Steinke . | |
| 4,667,581 | | 5/1987 | Hovland . | |
| 4,843,953 | | 7/1989 | Sells . | |
| 4,899,647 | | 2/1990 | Garries et al. . | |
| 4,924,761 | | 5/1990 | MacLeod et al. . | |
| 5,080,005 | | 1/1992 | Kolt . | |
| 5,092,225 | | 3/1992 | Sells . | |
| 5,328,407 | | 7/1994 | Sells . | |
| 5,344,363 | | 9/1994 | Pollock . | |
| 5,352,154 | | 10/1994 | Rotter et al. . | |
| 5,509,445 | | 4/1996 | Couet . | |
| 5,603,657 | | 2/1997 | Sells . | |
| 5,673,521 | | 10/1997 | Coulton et al. . | |
| 5,704,834 | | 1/1998 | Sells . | |
| 5,803,805 | | 9/1998 | Sells . | |
| 5,830,059 | | 11/1998 | Sells . | |
| 5,921,863 | | 7/1999 | Sells . | |

FOREIGN PATENT DOCUMENTS

| | | |
|---|---|---|
| 55-33523 | 8/1980 | (JP) . |

* cited by examiner

*Primary Examiner*—Harold Joyce
(74) *Attorney, Agent, or Firm*—Baker & Daniels

(57) ABSTRACT

A ridge vent assembly extends along the ridge of the roof of a building structure and is provided with multiple plies of corrugated material. The corrugations of the plies define small diameter passages that communicate a vent opening cut along the ridge of the roof with ambient atmosphere. A flexible member consisting of a strip of cloth material extends along the outer edge of the vent parts. The strip of material terminates into a flexible bubble. When wind speed increases above a predetermined wind speed, the movable member moves into a position adjoining the edge of the vent parts and the bubble is compressed against the upper edge of the corresponding vent part, thereby preventing entry of wind driven moisture and snow into the passages and into the building structure through the vent opening. Accordingly, the cloth strip and bubble act as a weather-stripping material for the vent. A similar cloth strip and bubble can be used to weatherstrip windows, doors, and other building openings by securing the movable member to the window or door frame.

32 Claims, 16 Drawing Sheets

ROOF VENTILATOR WITH MOVABLE MEMBER TO PREVENT ENTRY OF MOISTURE

This invention relates to a roof ventilating device which is provided with a movable member that prevents wind driven snow or rain from entering the building.

Roof ventilators have been used to prevent dangerous heat build-up in the attics or upper floors of houses and other structures. One such roof ventilator is disclosed in U.S. Pat. No. 3,949,657. The roof ventilators disclosed in this patent provide a cover for an elongated opening cut along the ridge of a roof. The ventilating device covers the opening, and provides relatively narrow passages to vent heat from the interior of the structure. The passages are designed to be small enough so that entry of moisture is restricted. However, during storms, wind driven rain or snow could be forced into the roof opening through the passages if the wind is strong enough.

According to prior U.S. patent application Ser. No. 08/269,916, filed Jun. 30, 1994, a movable member has a pressure-responsive surface that responds to ambient winds speeds in excess of a predetermined level to move into a closed position closing the passages. Accordingly, entry of moisture into the structure is restricted. The movable member in this prior application is relatively inflexible. Furthermore, it has been learned that under certain atmospheric conditions, wind speed across the tip of the baffle and the top of the ventilating device can act to partially open the baffle even after it has been closed, thereby permitting moisture to enter the structure.

The present invention provides a movable member made out of cloth, which is relatively flexible and thus is able to close against the outer edge of the ventilating device more easily than the relatively stiff movable member disclosed in my prior application. Furthermore, the upper edge of the present invention terminates in a flexible cavity or "bubble" that extends longitudinally along the edge of the movable member. During storms, the movable member first moves into a position to close the vent openings, and the bubble is thereafter deformed against the upper edge of the ventilating device, thus providing a seal to assure that snow and moisture will not enter the vent passages. The movable member acts as weatherstripping that seals against the ventilating device in response to wind speed. Accordingly, the present invention of an elongated strip of cloth material having a bubble extending along one edge thereof may also be used as weatherstripping around the edges of doors and windows. Furthermore, the deformable bubble may be used in other types of ventilating device according to other embodiments of the invention, in which a flexible bubble is mounted on relatively stiff baffles used in other types of ventilators.

The present invention also is substantially less expensive to manufacture than are other similar devices.

These and other advantages of the present invention will become apparent from the following description, with reference to the accompanying drawings, in which.

Figure 3:
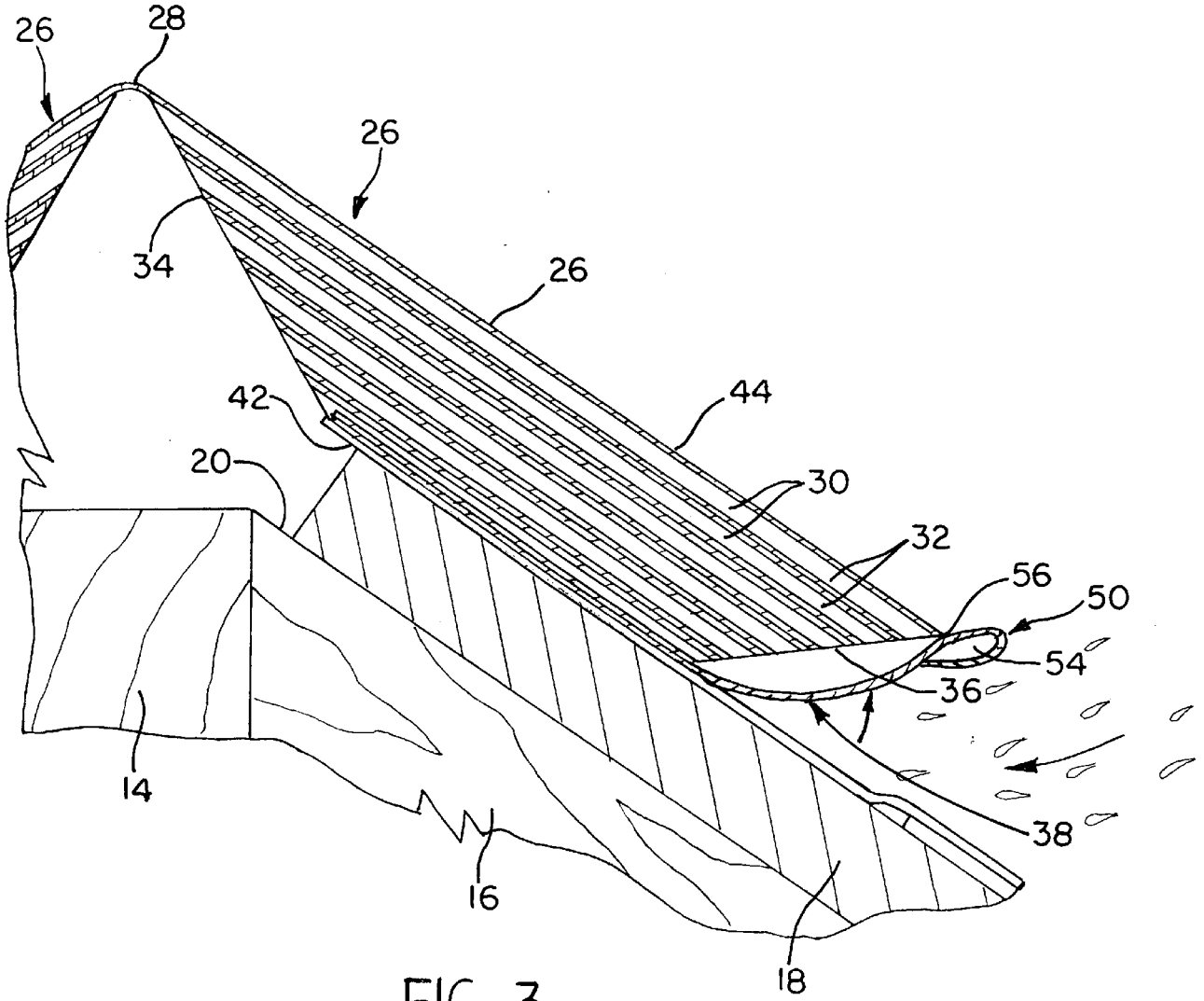
FIG. 3 is a fragmentary cross-sectional view taken through the ventilating device and the roof illustrated in FIG. 1.
Figures 4, 5:
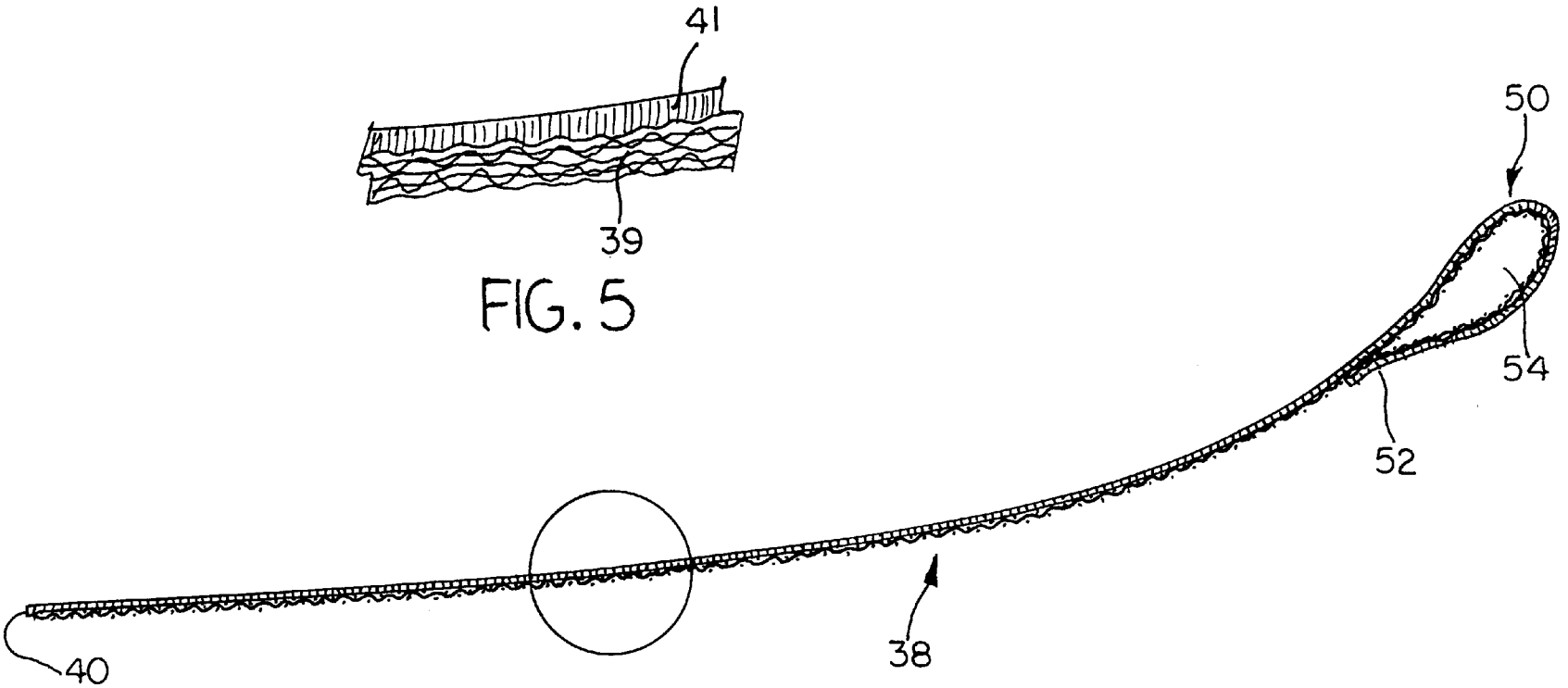
FIG. 4 is a detailed view of the movable member of FIG. 3.
FIG. 5 is an enlargement of the circumscribed portion of FIG. 4.

Referring now to FIGS. 1–5 of the drawings, a roof ventilating device shown generally by the numeral 10 is installed on the ridge of a roof generally indicated by the numeral 12. Roof 12 includes a longitudinally extending ridge member 14 and transversely spaced rafters 16 which are covered by underlayment or sheathing generally indicated by the numeral 18. A portion of the sheathing or underlayment 18 adjacent the ridge board 14 is cut away to define a longitudinally extending vent opening 20 (FIG. 3). Shingles 22 are applied to the sheathing or underlayment 18 to complete the roof.

The ventilating device 10 includes a pair of vent parts 26 that are connected by a connecting portion 28. Each of the vent parts 26 extend along opposite sides of the ridge board 14 and provide a cap or cover extending over the vent openings 20. As more clearly described in the aforementioned U.S. Pat. No. 3,949,657, (the entirety of which is incorporated herein by reference) the vent parts 26 each include several courses or plies of a corrugated material manufactured of a waterproof or weatherproof construction, such as plastic box stock. Plies are generally indicated by the numeral 30. Accordingly, each of the plies 30 consists of generally parallel passages 32 provided by the box stock corrugations each of which provide a small diameter passage for communicating the vent openings 20 with ambient atmosphere. The ends of the passages 32 define an inner edge 34 of the vent part 26 which extends over the vent openings 20, and the outer ends of the passages 32 define an outer edge 36. The ventilating device 10 is installed on the roof 12 by appropriate fasteners (not shown), such as roofing nails driven through each of the vent parts 26 at appropriate intervals along the length of the ventilating device.

According to the invention, a flexible baffle or movable member generally indicated by the numeral 38 consists of a strip of cloth that extends along the outer edge 36 of each vent part 26. In the embodiment of FIGS. 1–5, the member 38 is constructed of T YPAR® Barn Construction Fabric, Part No. 3304T-002, available from Reemay, Inc., Old Hickory, Tenn. TYPAR® barn construction fabric consists of a one or more layers of spunbonded olefin sheets, as indicated at 39 of high-density polyethelene fibers, available from DuPont, Inc., as "Tyvek®", which has been coated with a polymer coating 41 available from Techmer Coip., Knoxville, Tenn., sold as PM-9098E4. The barn construction fabric was selected because of its durability, in that roofs are commonly replaced only after 20–25 years, and the TYPAR barn construction fabric has the necessary durability. Other fabrics, such as canvas, may be used, but may have to be replaced at shorter intervals. The ventilating device 10 also includes an opposite upper surface 44, which is normally covered by shingles 46.

The baffle 38 includes an inner edge 40 (FIGS. 1 and 4) which is secured to the lower surface 42 (FIG. 3) of the ventilating device 10, which is applied directly to the roof 12. The ventilating device 10 also includes an opposite upper surface 44, which is normally covered by shingles 46. The movable member 38 is secured to the lower surface by a longitudinally extending sonic weld or impulse bond 48. The impulse bond 48 is formed in a conventional manner by bringing the welding head against the baffle 38 and compressing it against the vent part 26, heating the head, cooling the head, and then withdrawing the head. The head is heated for only a very brief time necessary to effect the weld, since the fabric or the cloth strip from which the baffle is made is relatively thin and appreciable heating would burn through the baffle. The outer end 50 (FIG. 4) of this movable member 38 is looped around and sealed to the flexible member by sonic welding or an impulse seal 52, which is formed in the same way as the impulse seal described above which attaches the baffle 38 to the corresponding vent part 26. Accordingly, an enclosed compartment is formed defining a compressible bubble 54. Of course, the movable member 38 may also be used without the bubble if desired, but as discussed above, the bubble 54 provides additional sealing when the movable member 38 is in the closed position.

Figure 1:
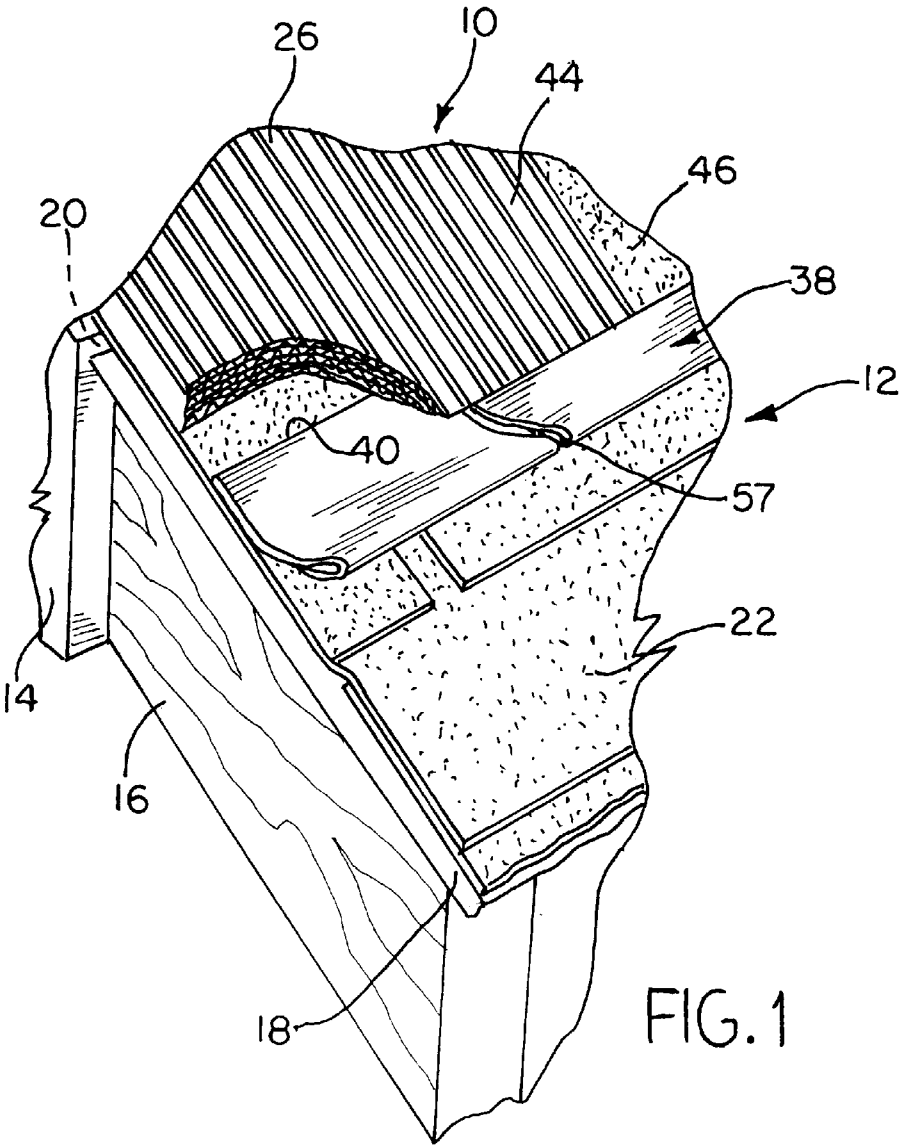
FIG. 1 is a perspective view, partly in section, of a ventilating device made pursuant to the present invention installed over a vent opening and a roof.
Figure 2:
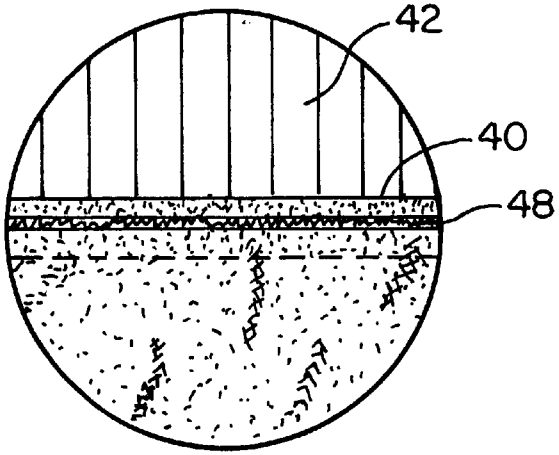
FIG. 2 is an enlarged view of a small portion of the bottom of the ventilating device illustrated in the manner in which the flexible member is attached to the ventilating device.

As illustrated in FIG. 1, the member 38 may be divided into sections by kerf 57 cut transversely across the strip, thereby permitting each individual section of the movable member to respond individually to ambient wind conditions. Of course, if a continuous and uninterrupted strip is provided, the strip opens and closes as a unit.

When ambient wind conditions are low, the movable member 38 rests on the shingles 22, thereby opening the passages 32 to permit venting of air from the attic or upper story of the structure covered by the roof through the vent opening 20 and the passages 32. However, when ambient speeds increases to a predetermined wind speed, the movable member 38 responds to the wind, it being noted that the bubble 54 forms a lip which is caught by the wind, which forces the movable member to the closed position illustrated in FIG. 3. The width of the movable member 38 is such that the bubble 54 engages the corner 56 between the outer edge 36 and the upper surface 44 of the vent parts 26. Increasing wind speed thereafter compresses the bubble 54 against the corner 56, it being noted that the width of the movable member 38 is such that the bubble extends above the corner 56 a small distance. Because of the compression of the bubble 54 against the corner 56, a seal restraining entry of wind driven moisture and snow is provided, and the movable member 38 cannot be forced away from the edge 36 by aerodynamic conditions, as was the case in the prior art devices.

In some areas that are susceptible to forest fires, the movable member may be provided with a fire resistant skin (such as aluminum foil) on the side of the movable member 38 that rests against the roof in the inactive position. Accordingly, when the movable member 38 is moved to the active position illustrated in FIG. 3 in response to ambient wind conditions, wind blown embers are deflected by the outer skin of the movable member 38.

Figure 7:
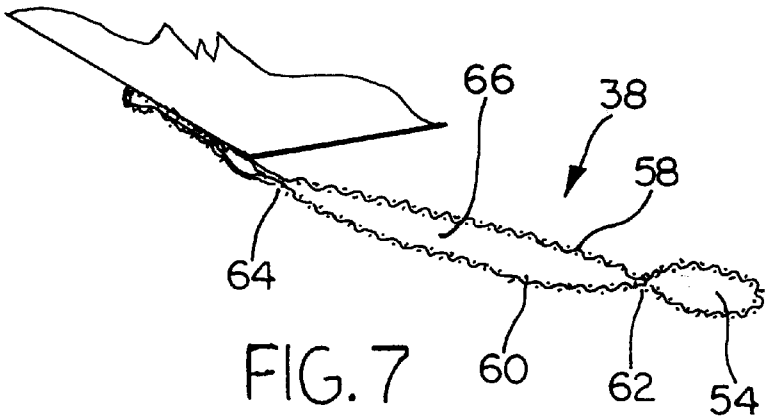
FIG. 7 is an enlarged cross-sectional view of the movable member illustrated in FIG. 6.
Figure 6:
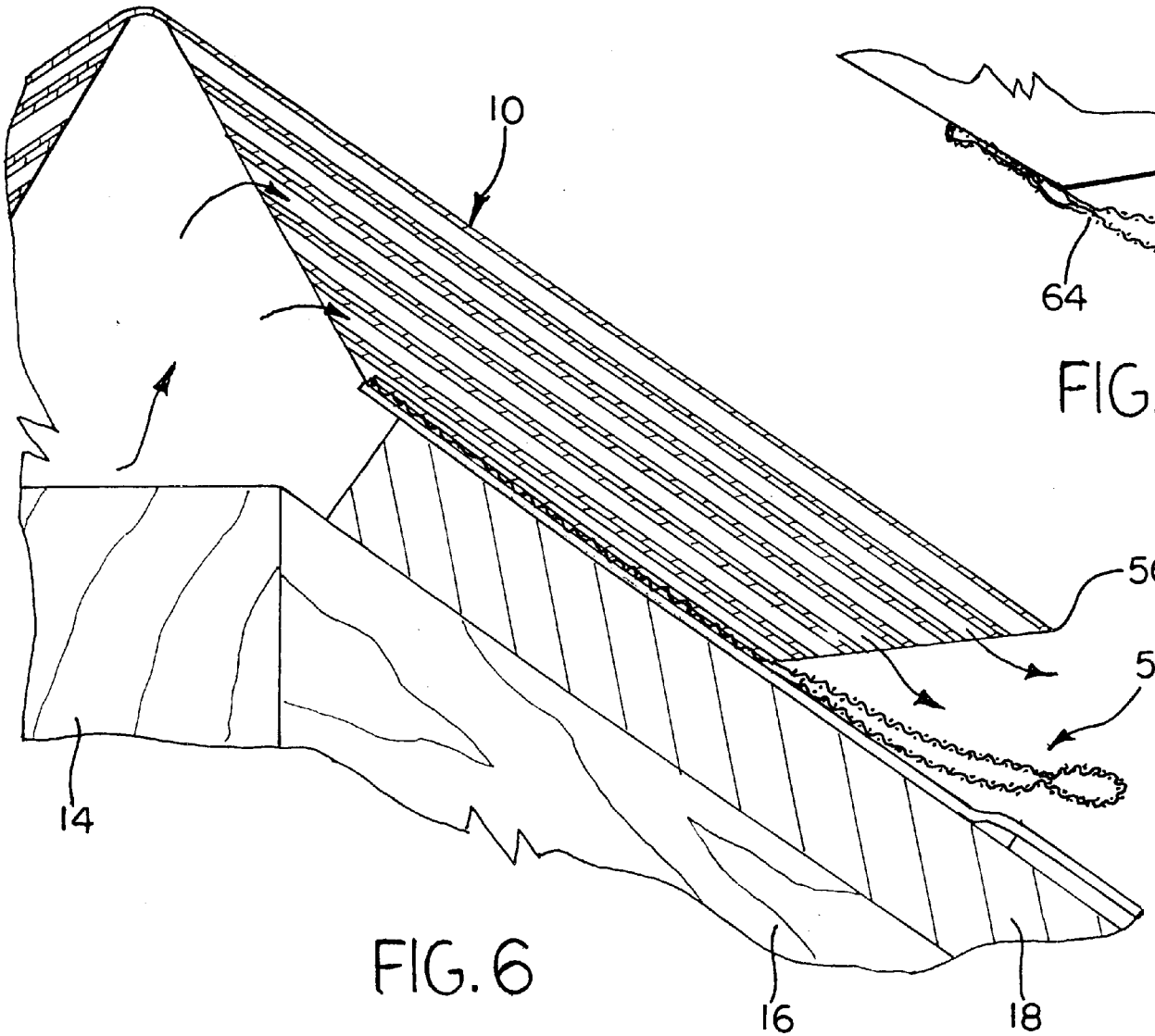
FIG. 6 is a view similar to FIG. 3, of an alternate embodiment of the invention and illustrating the movable member in the open or inactive position in response to ambient wind speed in excess of a predetermined level.
Figure 8:
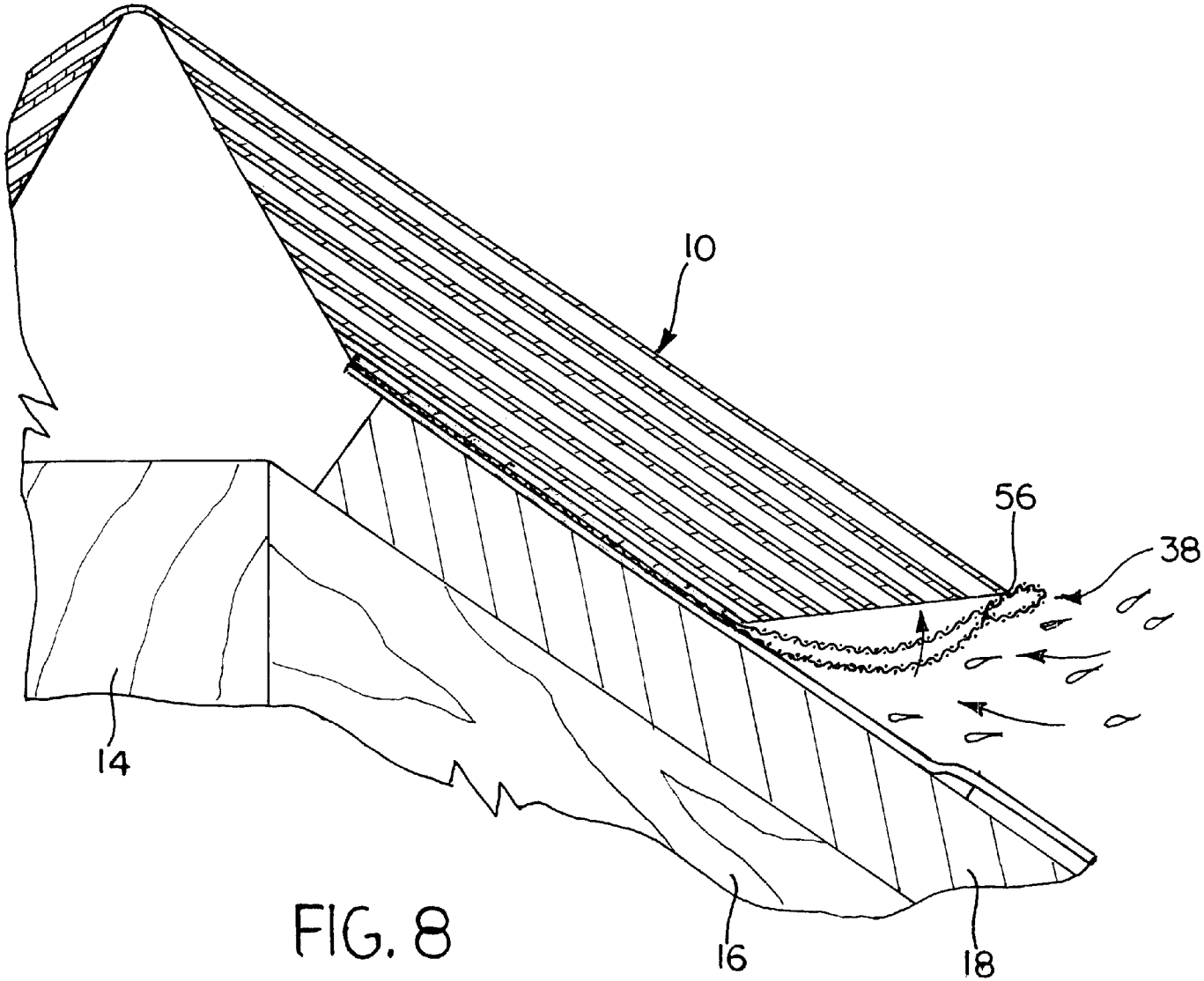
FIG. 8 is a view similar to FIG. 6, but illustrating the movable member in the closed position.

Referring now to the embodiment of FIGS. 6–8, the baffle 38 consists of an upper layer 58 and lower layer 60 of Tyvek® fabric, (without the polymer coating used in barn covering). The layers 58 and 60 are impulse sealed at 62 to form the bubble 54, and are also impulse sealed at 64, to thereby form a cavity 66 between the layers 58 and 60. If the bubble 54 is not desired, the impulse seal 62 may be eliminated. In either case, the width of the movable member 38 is such that the movable member 38 can wrap around the corner 56, to thereby provide at least partial sealing. The Tyvek® fabric, by its nature, prevents moisture from passing through the fabric, but allows some "breathing" of air through the fabric.

Figure 10:
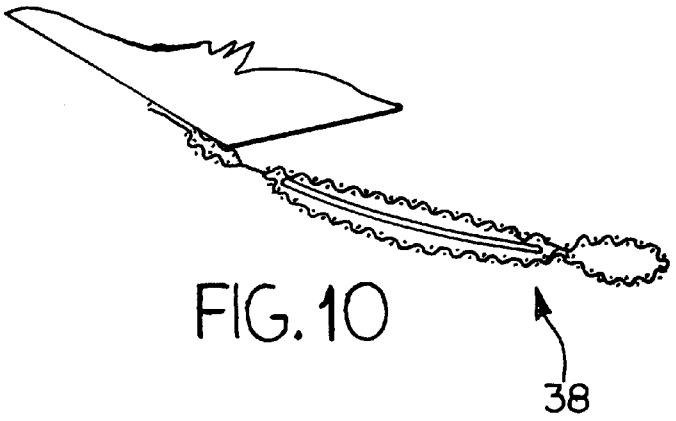
FIGS. 9–11 are views similar to FIGS. 6–8, respectively, but illustrate another alternate embodiment of the invention.
Figure 9:
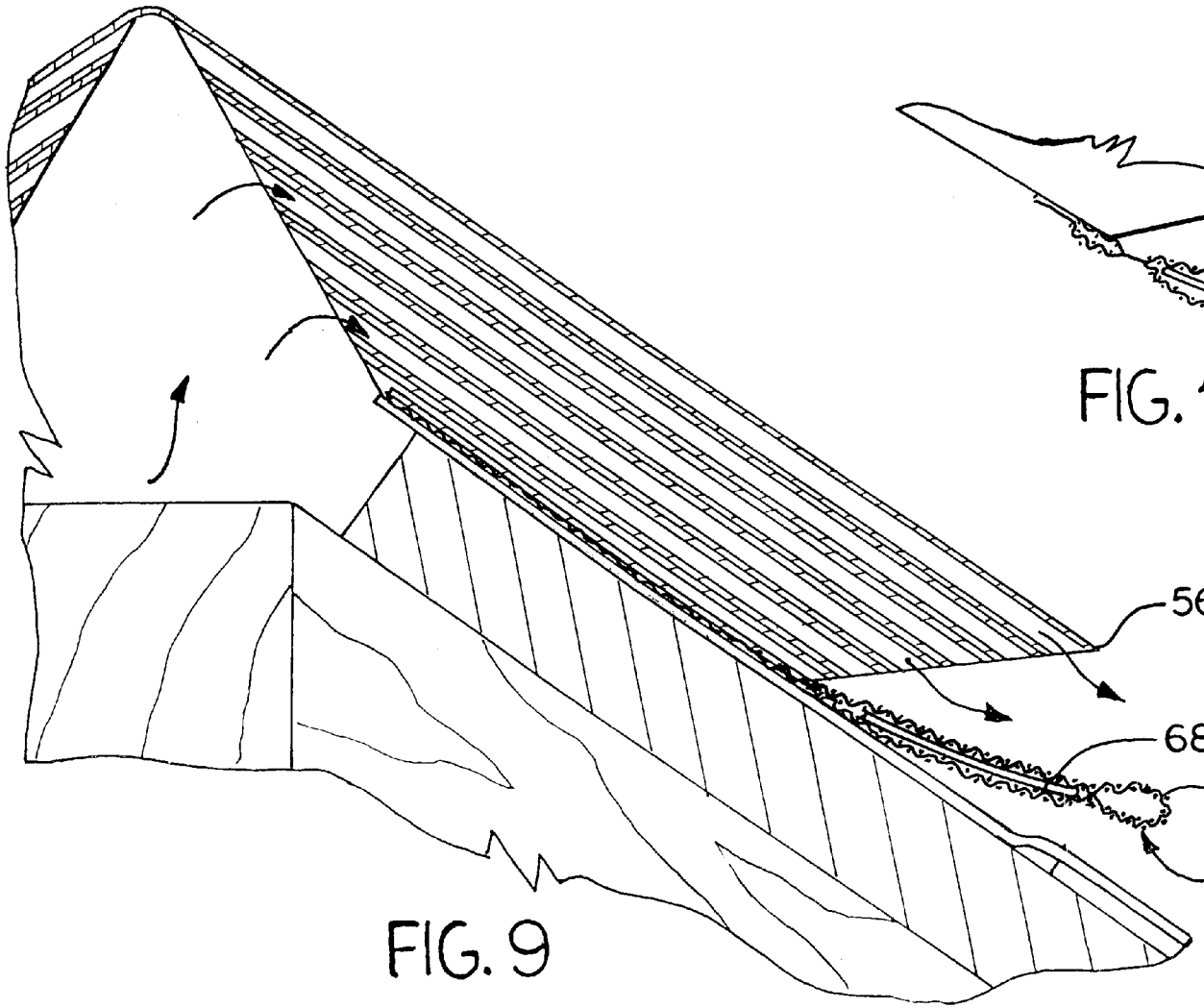
Figure 11:
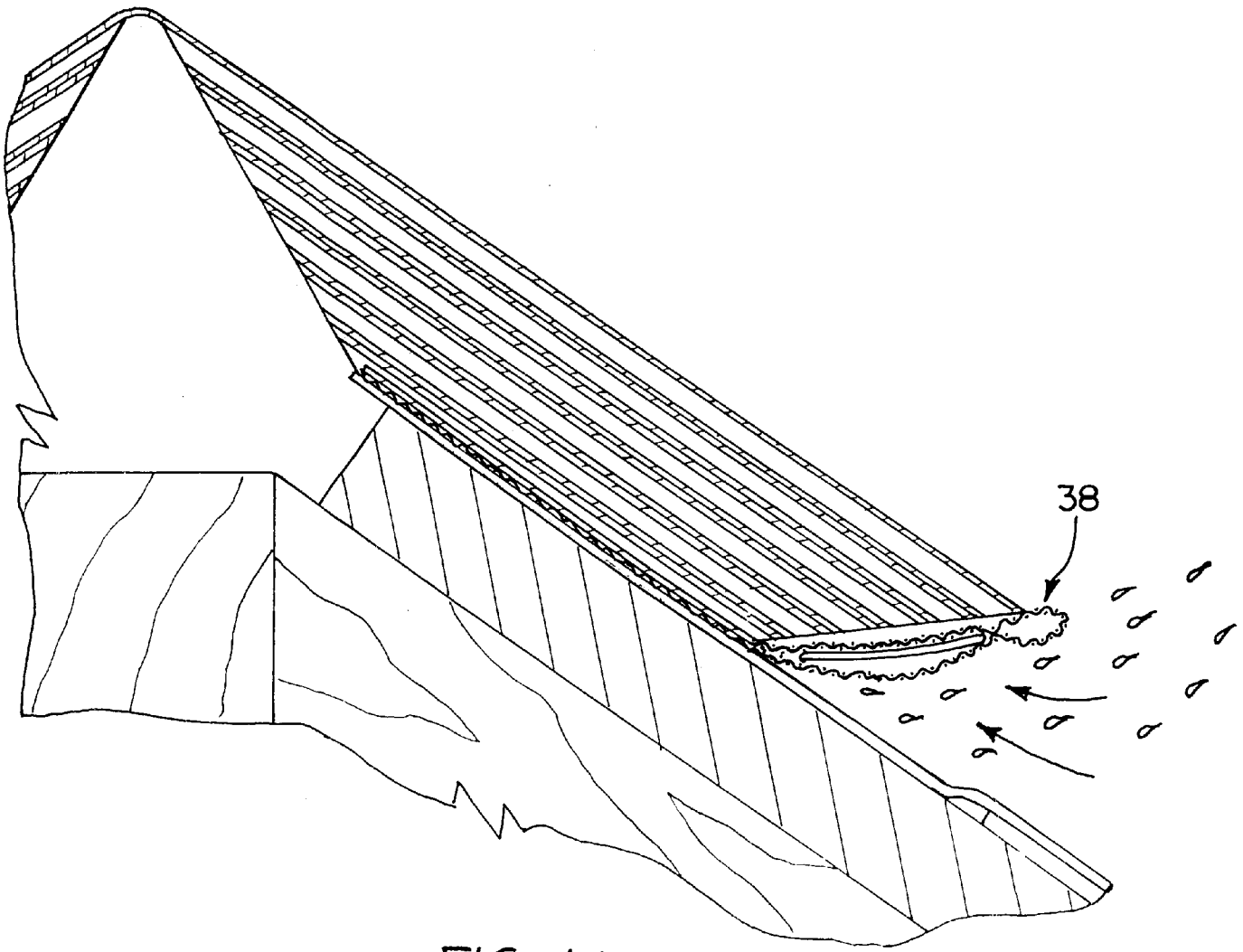

Only two layers 58 and 60 are provided in the embodiment of FIGS. 6–8; accordingly, the member 38 will close at a relatively low wind speed, which may be so low that the movable member closes during conditions in which moisture ingestion is not a problem and it is desired that the full venting capacity of the passages 32 be provided. Accordingly, referring now to the embodiment of FIGS. 9–11, a longitudinally extending, rigid baffle 68 is installed in the compartment 66 to increase the weight of the movable member 38, thereby also increasing the wind speed required to move the movable member with the baffle to the active or closed position with the bubble 54 compressed against the corner 56. Again, the bubble is optional and provides the sealing feature, but the movable member comprised of a cloth strip with the baffle installed therein and without the bubble may also be used.

Figure 13:
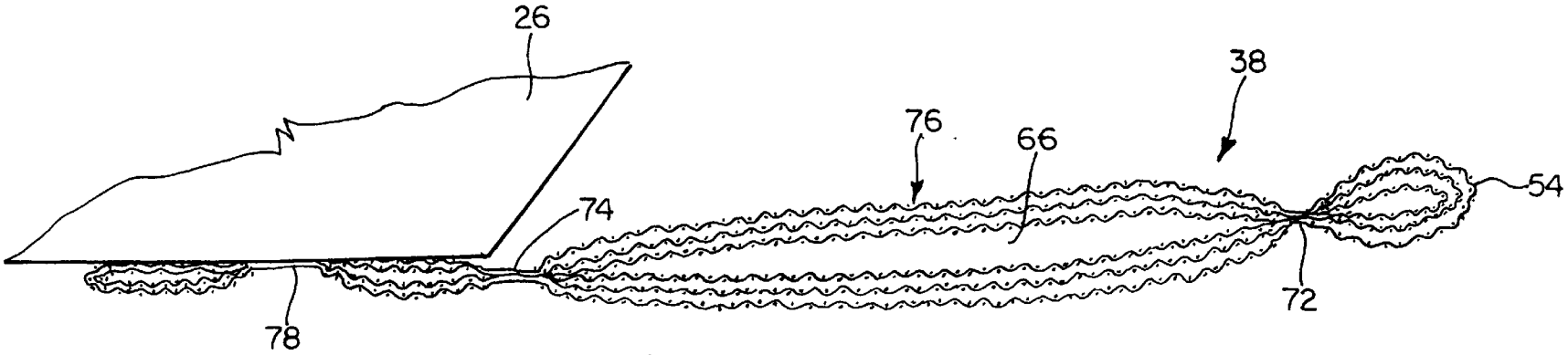
FIGS. 12 and 13 are enlarged views of another embodiment of the movable member incorporated with the ventilating device of the present invention, in which the movable member consists of multiple layers out of fabric.
Figure 12:
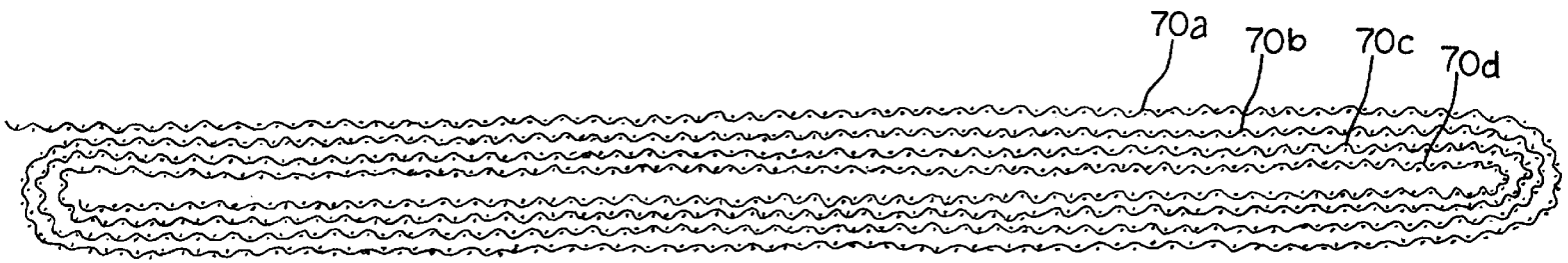

Referring now to FIGS. 12 and 13, the movable member 38 may be made of multiple layers of the aforementioned Tyvek® fabric. As illustrated in FIG. 12, a sheet of Tyvek® fabric of the appropriate length and width is wound into multiple layers 70*a*, 70*b*, 70*c*, 70*d*. Other appropriate materials that are sufficiently flexible, such as canvas, may also be used. An impulse seal as described above is applied at 72 to form the bubble 54, another impulse seal is applied at 74, to define the active portion 76 of the movable member 38, and a third impulse seal 78 secures the movable member to the vent part 26. As also discussed above, the bubble 54 may be eliminated by simply omitting the impulse seal 72. Due to the multiple layers, the wind speed required to move the movable member 38 from the inactive to the active position is increased proportionally over the wind speed required to move the single layer to the active position. Accordingly, the wind speed in which the movable member 38 responds may be adjusted by adjusting the number of layers of fabric used. A baffle, if necessary, may also be installed in the compartment 66 to further weight the movable member, thus further increasing the speed in which the movable member responds.

Figures 14, 14A, 15:
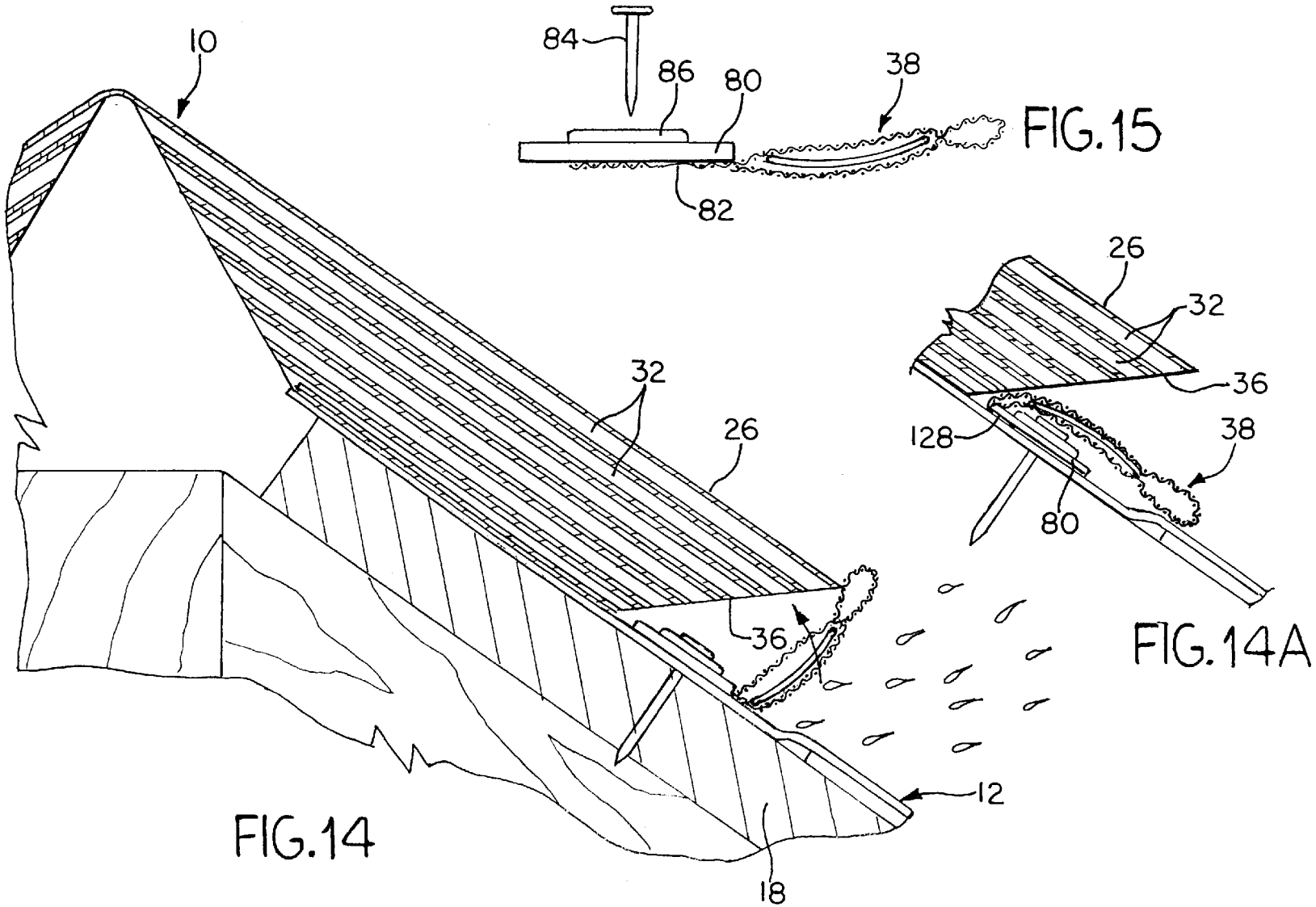
FIG. 14 is a view similar to FIG. 3, but illustrating yet still another embodiment of the present invention, in which the movable member of the present device may be retrofitted onto structures which have been provided with a roof ridge vent, such that when problems of moisture ingestion occur, the present invention may be retrofitted to existing ventilating devices.
FIG. 14A is a fragmentary view of a portion of FIG. 14, but illustrating still another embodiment of the present invention.
FIG. 15 is an enlargement of a portion of FIG. 14.

Referring now to FIGS. 14 and 15, many ventilating devices 10 have been installed on roofs during the time prior to the present invention that have proven to be especially susceptible to moisture ingestion, because of the location and a number of environmental factors. Accordingly, it is desirable to be able to retrofit the present invention on existing structures equipped with ridge vents. Referring to FIGS. 14 and 15, the movable member 38 may be made according to any of the above-described embodiments, the particular movable member 38 illustrated in FIGS. 14 and 15 also being illustrated in FIGS. 9–11. The movable member 38 is impulse welded to a rather narrow reinforcing strip 80 by impulse weld 82. The reinforcing strip 80, with movable member 38 attached to the bottom thereof extends longitudinally along the reinforcing strip 80. The reinforcing strip 80, with the movable member 38 attached thereto, comprises a retrofit assembly which can be supplied to roofing contractors for installation on the roof of a house equipped with a ridge vent 10 to prevent ingestion of wind driven moisture and snow. The device is installed by driving appropriate fasteners 84, such as roofing nails, through a reinforcing washer 86 and the reinforcing strip 80 and into the underlayment 18. It is important that the reinforcing strip 80 be installed as close to the edge 36 as possible, to permit the movable member 38 to move from the inactive position illustrated in FIG. 15 to the active position illustrated in FIG. 14 in response to ambient wind conditions to prevent ingestion of wind driven moisture and snow into the passages 32.

Referring now to the embodiment of FIG. 14A, which is similar to the embodiment of FIGS. 14 and 15, the moveable member 38 is attached to the edge 128 of the reinforcing strip 80 closest to the vent part 26. The moveable member is folded around the edge 128 of the reinforcing member 80 closest to the vent part 26 and in the inactive position lays over the reinforcing strip 80, thus protecting the reinforcing strip 80 from the deliterious effects of sun light and other environmental factors. The weight and flexibility of the moveable member 38 is such that it remains in the position illustrated in FIG. 14A as long as the wind speed is below a predetermined wind speed, but when wind speed increases the moveable member 38 is forced against the edge 36 of the vent part 26, thereby preventing wind driven snow and moisture from entering the passages 32. When the wind speed decreases, the weight of the moveable member 38 assures that it will be moved away from the edge 36 into the inactive position illustrated in FIG. 14A.

Figure 16:
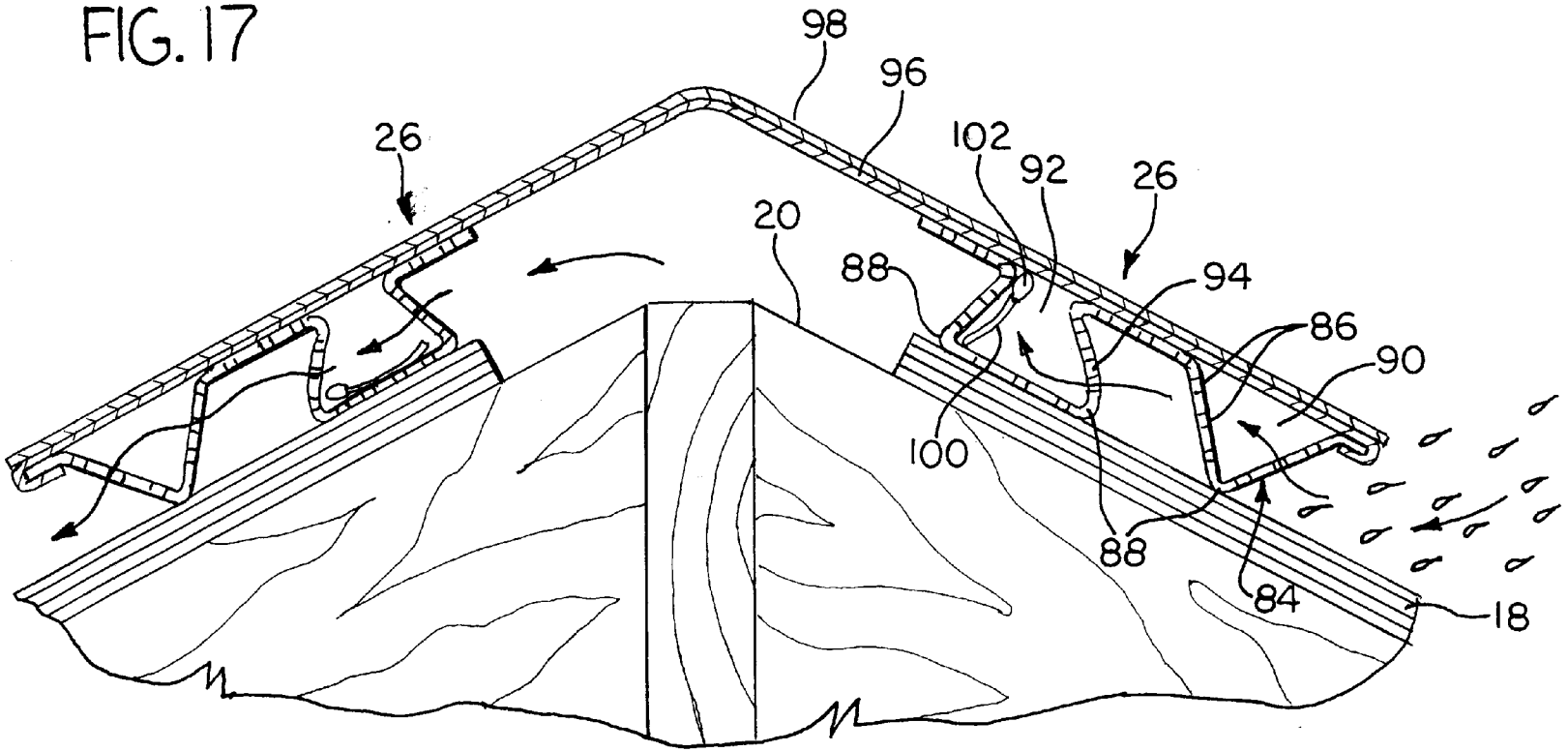
FIG. 16 is a view similar to FIG. 3, but illustrating another embodiment of the invention in which a rigid baffle within a perforated compartment is provided with a sealing bubble along one edge thereof.
Figure 17:
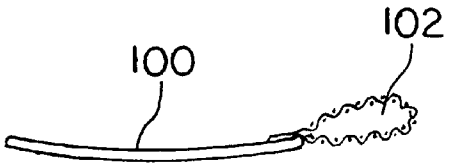
FIG. 17 is an enlarged view ol the baffle illustrated in FIG. 13.
Figure 18:
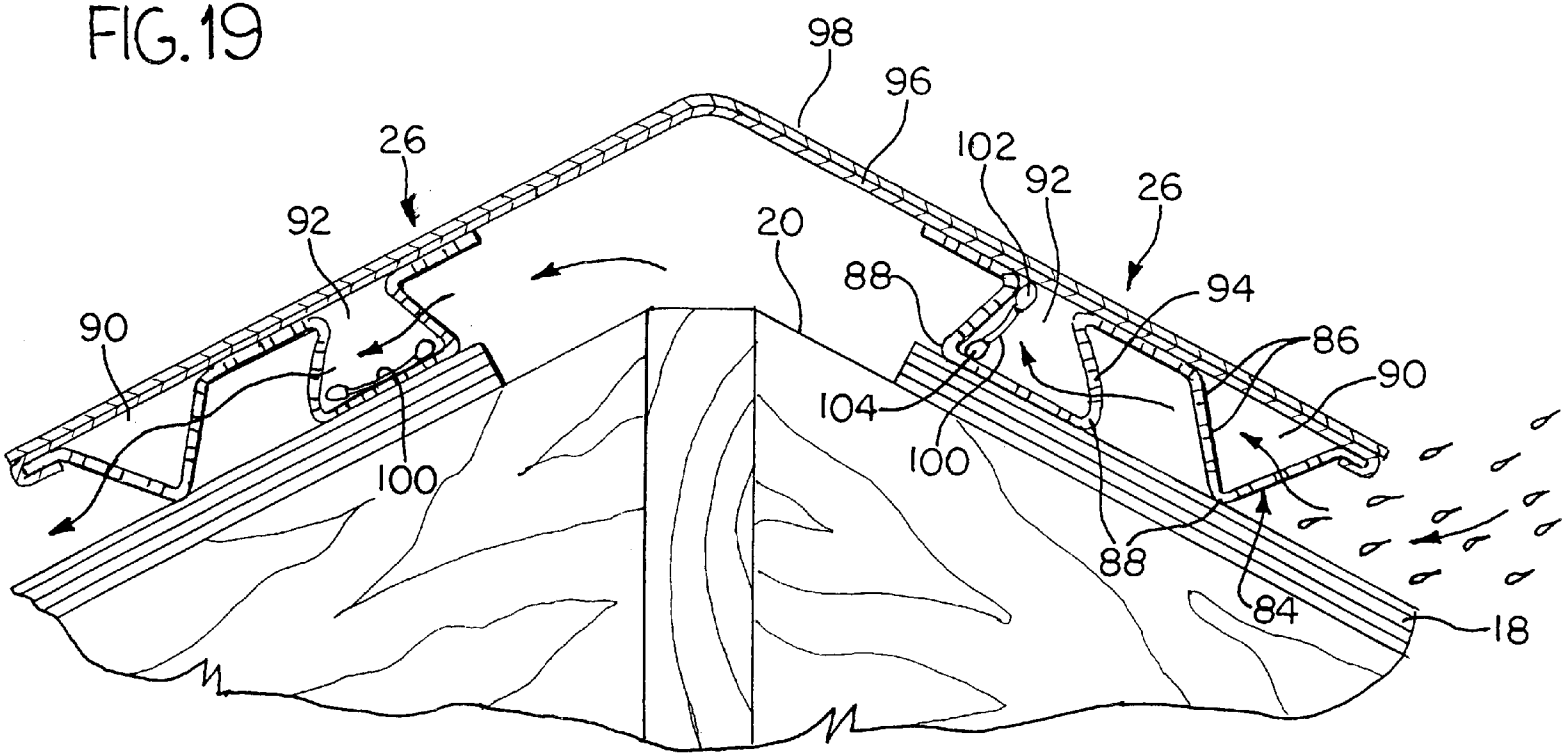
FIG. 18 is a view similar to FIG. 13, but illustrating another embodiment of the invention in which sealing bubbles are provided along both edges of the baffles.
Figure 19:
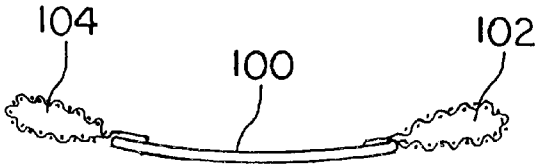
FIG. 19 is a view similar to FIG. 14, but of the baffle illustrated in FIG. 15.

Referring now to the embodiment of FIGS. 16–18, vent parts 26 include a sheet 84 of sheet metal or plastic material perforated as indicated at 86. Each sheet 84 is folded as indicated at 88 to define compartments 90, 92. Compartment 90 has a cross-sectional shape that is roughly triangular, and compartment 92 has a cross-sectional shape that is roughly that of a truncated triangle. The side 94 of compartment 92 which faces away from the opening 20 is slightly curved as indicated in the drawings. A cap plate 96 closes the upper surface of the compartments 90, 92 and shingles 98 are applied thereto. The shingles 98, cap plate 96 and folded sheet metal or plastic 84 are all nailed to the underlayment 18 by roofing nails (not shown). A longitudinally extending baffle 100 is confined by the walls of the compartment 92, but is otherwise unattached thereto. As illustrated in FIGS. 16–17, the baffle 100 has a curved cross section terminating in upwardly projecting lips at opposite ends thereof. A flexible bubble 102 is comprised of a loop of the aforementioned Tyvek® and is joined to one of the ends of the baffle 100 that, when the baffle is in the inactive or open position, points away from the opening 20. The lip at the end of the baffle upon which the bubble is mounted responds to the wind blowing through the perforations 86 catches the lip of the baffle 100 forcing it from the inactive position, in which the baffle lays on the bottom of the compartment 92 to the active position in which the baffle 100 is raised to prevent ingestion of moisture and snow, the bubble 102 sealing against the upper corner of the compartment 92. If necessary, and as illustrated in FIGS. 18 and 19, a second bubble 104 can be provided at the opposite end of the baffle 102, so that when the baffle is in the active position, sealing occurs on both ends of the baffle, to further resist entry of moisture into the building structure. As illustrated in FIGS. 16 and 18, the baffle on the vent part on the right side of the Figure is illustrated in the closed position, the arrows indicating the direction of the wind that acts against the baffle 100. The baffles on the left side illustrate the baffle in the inactive position and the arrows indicate the direction that heat is vented from the structure.

Figure 20:
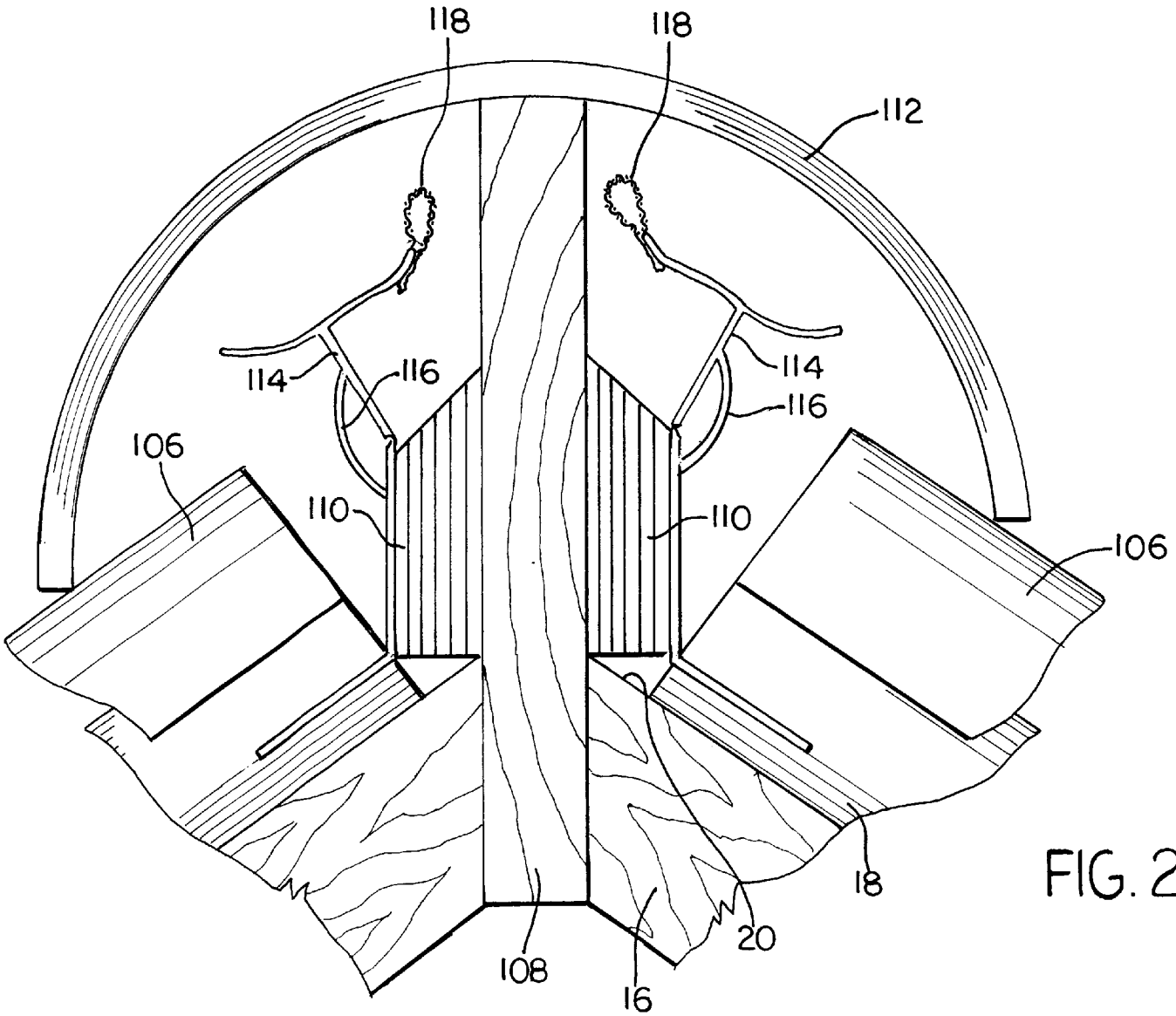
FIG. 20 is a fragmentary, transverse cross-sectional view illustrating still another embodiment of the invention.
Figures 21, 22:
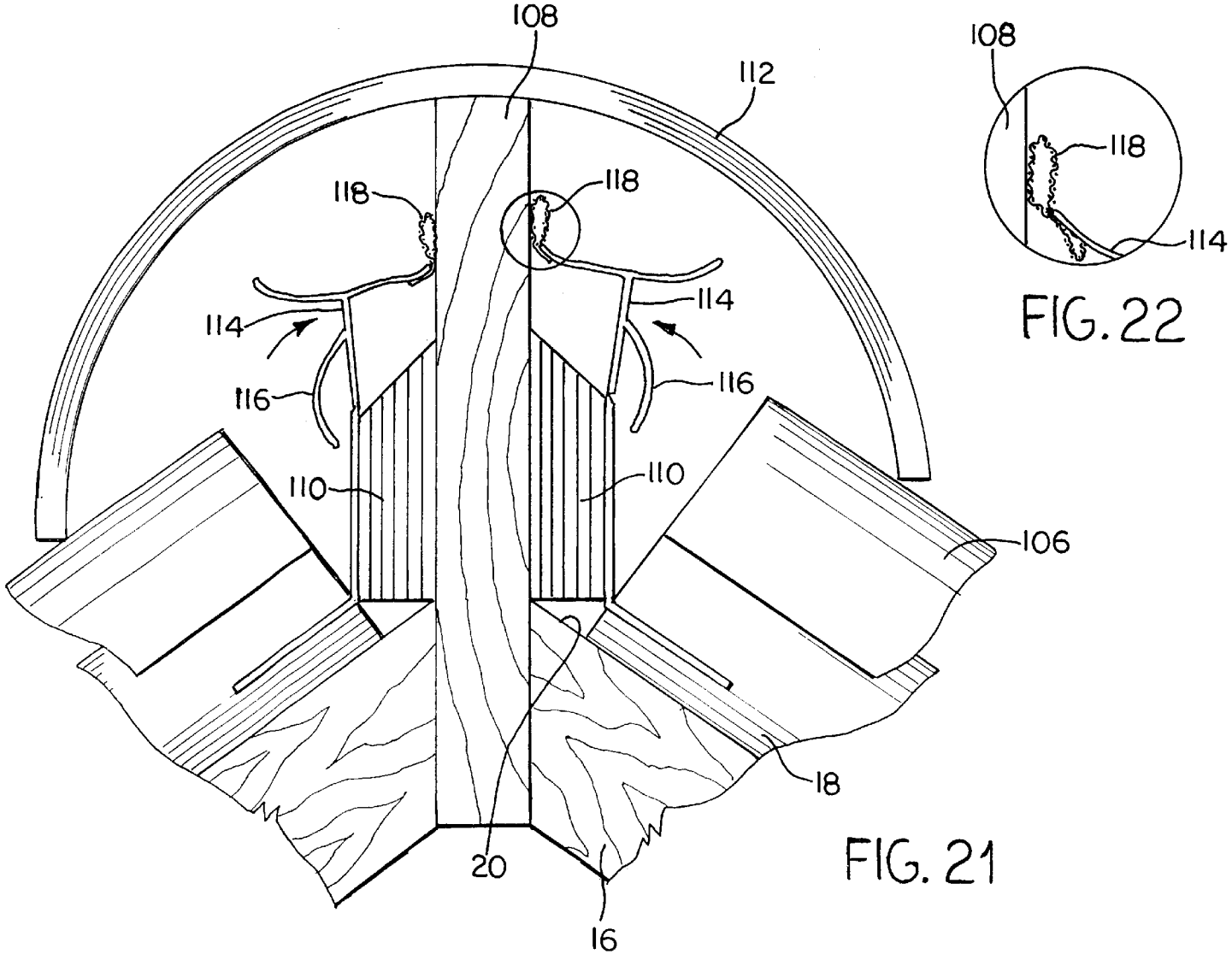
FIG. 21 is a view similar to FIG. 20, but illustrating the movable members in the closed position.
FIG. 22 is an enlargement of the circumscribed portion of FIG. 21.

Referring now to FIGS. 20–22, a tile vent system includes roofing tiles 106 laid directly upon underlayment 18, which is supported by rafters 16. A ridge board 108 extends upwardly from the rafters 16. A vent opening 20 is provided between the underlayment and the ridge board 108. Vent parts 110 are nailed to the ridge board 108 over the vent openings 20, and are made from the same material as are the vent parts 26, except that the vent parts 110 are nailed to the ridge board 108 with the passages oriented vertically. A cap tile 112 is secured to the top of the ridge board 108. A pair of arms 114 are hingedly connected to the outer edge of the vent parts 110, and the outward deflection of the arms 114 arc as restricted by leg 116.

Bubbles 118 of the aforementioned Tyvek® material are welded to the arms 114, for engagement with the ridge board 108 to prevent moisture from being blown through the vent parts 110.

Figure 23:
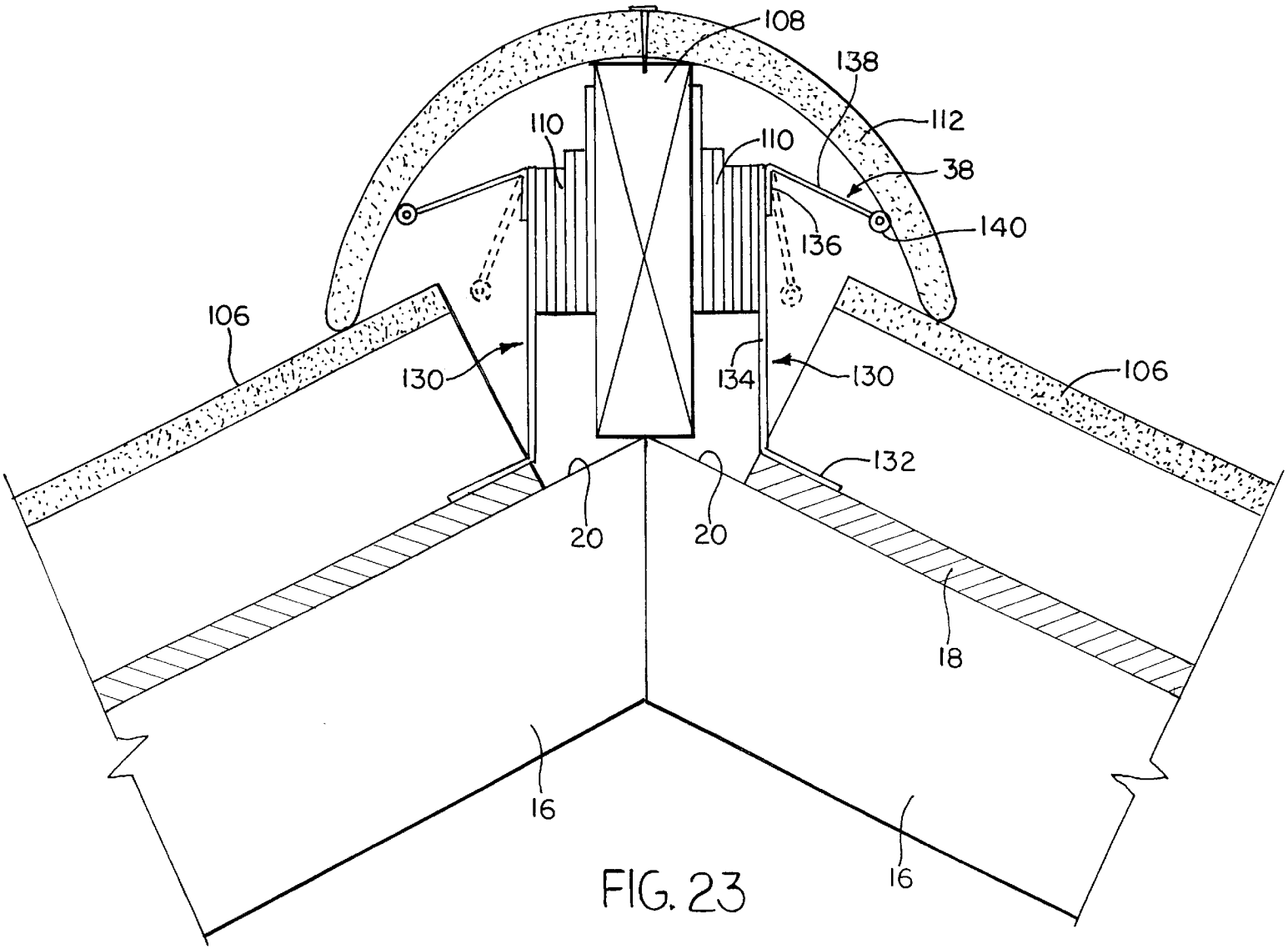
FIG. 23 is a view similar to FIG. 20, but illustrating still another embodiment of the invention.

Referring now to FIG. 23, tiles 106 are laid on underlayment 18 and cap tile 112 is installed on ridge board 108 in the same manner as that described with respect to the embodiment of FIG. 20. An elongated flashing strip generally indicated by the numeral 130 consists of longitudinally extending leg 132 and longer longitudinally extending leg 134, which extends upwardly at an angle with respect to the leg 132. Leg 132 is nailed to the underlayment 18, and leg 134 is secured to the ridge board 108 by driving fasteners (such as nails) through leg 134 and the vent part 110 and into the ridge board 108. The flexible member 38 includes a reinforcing strip 136 which is secured to the leg 134 of the flashing 130. The moveable portion 138 of the moveable member 38, which terminates in a bubble 140 and is made of the same materials and in the same way as the embodiment of FIGS. 1–5, is secured to the reinforcing strip 136. Accordingly, moveable member 38 is moveable between an inactive position illustrated in the dashed lines in FIG. 23 to the active position illustrated by the solid lines in response to wind speed. In the active position, the bubble 140 is compressed against the cap tile 112, thereby preventing moisture from being blown around the inner surface of the cap tile 112 and into the passages defined within the vent parts 110.

Figure 24:
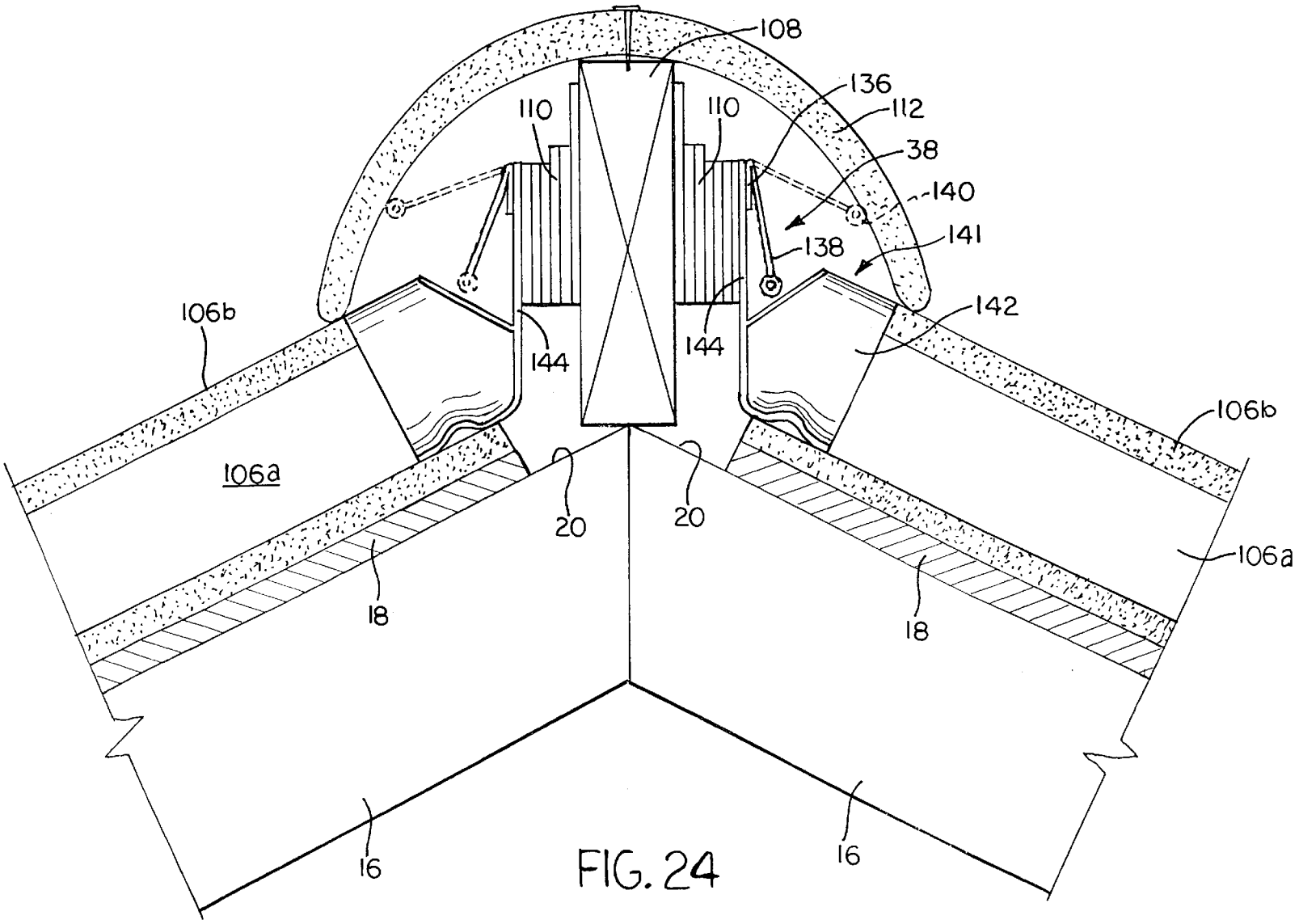
FIG. 24 is a view similar to FIG. 20, but illustrating still another embodiment of the invention.

The embodiment of FIG. 24 is similar to the embodiment of FIG. 23, except that the flashing 130 is replaced by flashing generally indicated by the numeral 141 which is sold by So-Lite Corporation, San Jose, Calif. under the trademark Weatherblock®. Conventionally, tiles 106 are laid on underlayment 18 in alternating fashion with alternating tiles placed with the curved surface facing away from the underlayment 18 and 18 with the curved surface facing the underlayment 18. The upwardly facing tiles of FIG. 24 are indicated as 106*a*, and the downwardly facing tiles are indicated at 106*b*. The flashing 141 includes a scalloped portion 142 that is scalloped to follow the contours of the alternating upwardly facing and downwardly facing tiles 106*a*, 106*b*. The scalloped portion 142 is provided with a substantially flat, longitudinally extending, upwardly projecting arm 144 that extends along the sides of the vent parts 110. Arm 144 is fastened to the ridge board 108 by driving fasteners, such as nails, through the arm 144 and the vent parts 110 into the ridge board 108. The moveable member 38 is installed on arm 144 by securing reinforcing strip 136 to the arm 144 as described above with respect to FIG. 23. Accordingly, the flexible portion 138 is moveable from an inactive position illustrated in the solid lines in FIG. 24 to an active position illustrated by the dashed line, in response to an increase in ambient wind speed. In the active position, bubble 140 is compressed against the inner surface of cap tile 112.

Figure 25:
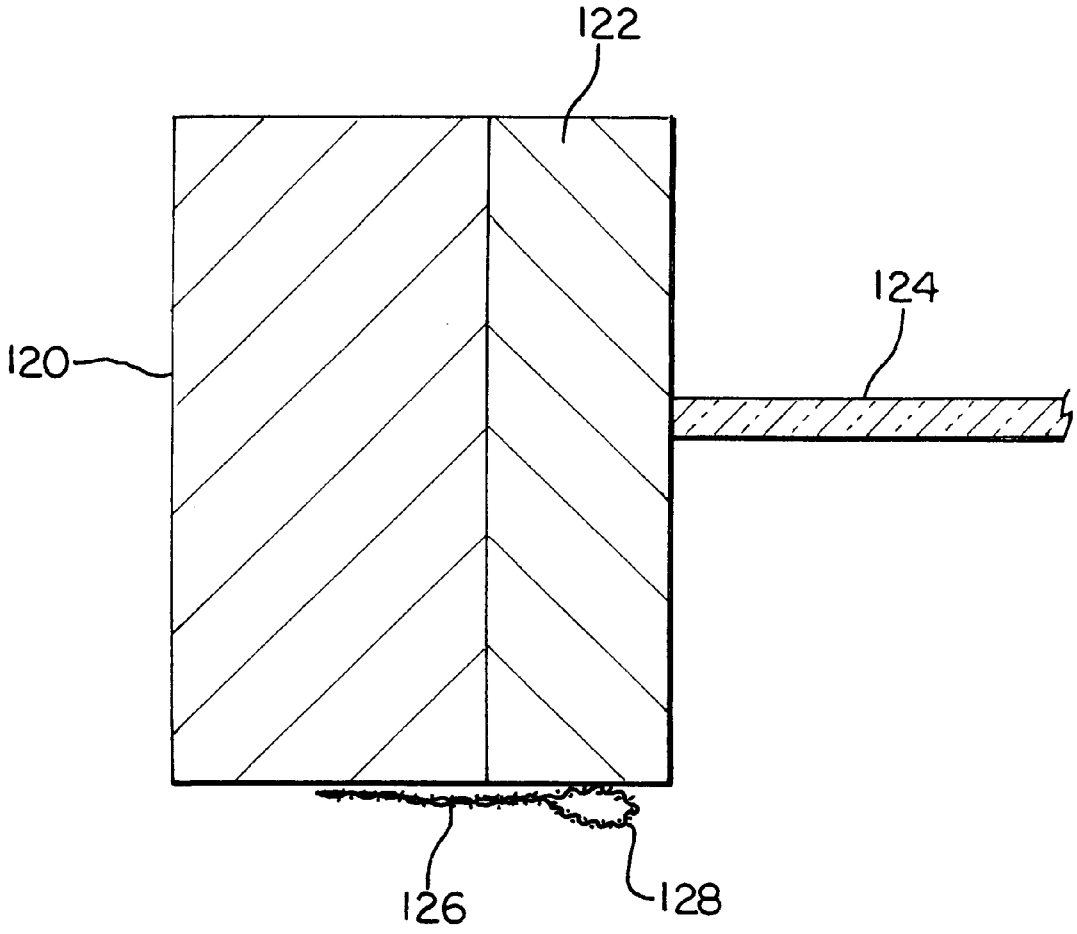
FIG. 25 is a cross-sectional view looking downwardly taken through a window sash and frame illustrating my invention used as weatherstripping.

The movable member 38 and bubble 54 can also act as a weatherstripping to prevent entry of moisture into other vented areas. Accordingly, the weatherstripping provided by the flexible member 38 and bubble 54 may also be applied to windows, doors, and other structural components. Referring to FIG. 25, a window frame as generally indicated at 120 in cross section. A window sash as similarly indicated in cross section at 122. A window pane 124 extends from the sash 122. Weatherstripping generally indicated by the numeral 126 includes a bubble 128 that is deflected against the sash 122 in response to increasing wind speeds, thereby preventing entry of wind between the interface between the sash 122 and frame 120.

What is claimed:

1. A ventilating device for a roof having a longitudinally extending ridge member supported by transversely spaced inclined rafters, a vent opening extending substantially parallel to said ridge member, said ventilating device including a cap for said vent opening, said cap extending along said vent opening substantially parallel to said ridge member and including a pair of longitudinally extending vent parts extending along said vent opening substantially parallel to said ridge member, each of said vent parts being mounted on said roof on opposite sides of said vent opening and defining a plurality of vent passages for communicating the vent opening to ambient atmosphere, and an elongated, longitudinally extending, flexible strip extending along said vent parts substantially parallel to the vent opening, said flexible strip being movable from an inactive position permitting communication through said passages to an active position closing said vent passages to prevent entry of wind driven moisture into said passages, said flexible strip being responsive to wind in excess of a predetermined ambient wind speed to move from the inactive position to the active position, said flexible strip being restored by gravity to the inactive position when the ambient wind speed drops below said predetermined ambient wind speed.

2. Ventilating device as claimed in claim 1, wherein said flexible strip is defined between a pair of edges extending longitudinally parallel to said vent opening, one of said edges being held against said roof, the other edges moving to a position engaging a corresponding vent part when the flexible strip is in the active position.

3. Ventilating device as claimed in claim 2, wherein the width of the flexible strip between said edges is greater than the distance between the upper surface of the vent parts and said roof.

4. Ventilating device as claimed in claim 2, wherein the upper surface of said vent parts is defined by an outer edge extending substantially parallel to said vent opening, said other edge of said flexible strip terminating in a longitudinally extending compressible bubble extending along said other edge parallel to said vent opening, said bubble being compressed against said outer edge of the upper surface of the corresponding vent part when the ambient wind speed is above a predetermined wind speed.

5. Ventilating device as claimed in claim 4, wherein said bubble is a turned over edge portion extending from a main body portion of said flexible strip, said turned over portion being secured to the main body portion to form said bubble.

6. Ventilating device as claimed in claim 1, wherein said flexible strip is configured of a spun-bonded olefin sheet of high density polyethylene fibers.

7. Ventilating device as claimed in claim 6, wherein said spun-bonded olefin sheet is coated with a polymer coating.

8. Ventilating device as claimed in claim 1, wherein said vent parts have a lower surface engaging said roof, said flexible strip having a longitudinally extending edge portion terminating in said one edge, said edge portion being secured to said lower surface.

9. Ventilating device as claimed in claim 1, wherein said vent parts have a lower surface engaging said roof, said flexible strip having a longitudinally extending edge portion terminating in said one edge, said edge portion being clamped between said lower surface and said roof.

10. Ventilating device as claimed in claim 1, wherein said flexible strip includes a lower skin resting on said roof when the flexible strip is in the inactive position, said skin including a fire resistant material, whereby when the flexible strip is in the active position the fire resistant material deflects burning embers thereby resisting burning of the flexible strip and ingestion of embers into the vent passages.

11. Ventilating device as claimed in claim 1, wherein said flexible strip includes a loop of cloth defining a compartment there within.

12. Ventilating device as claimed in claim 11, wherein said loop defines an active portion of said flexible strip which moves between said active and inactive positions, said active portion extending between opposite ends of said loop, and an inactive portion of said flexible strip extending from one end of said loop, said inactive portion securing said loop.

13. Ventilating device as claimed in claim 11, wherein a baffle is installed in said compartment to weight said loop to the inactive position, whereby wind at a speed in excess of the predetermined speed is necessary to maintain the loop to the active position.

14. Ventilating device as claimed in claim 11, wherein said loop includes multiple layers of fabric.

15. Ventilating device as claimed in claim 11, wherein the upper surface of said vent parts is defined by an outer edge extending substantially parallel to said vent opening, said other edge of said loop terminating in a longitudinally extending compressible bubble extending along said other edge parallel to said vent opening, said bubble being compressed against said outer edge of the upper surface of the corresponding vent part when the ambient wind speed is above a predetermined wind speed.

16. Ventilating device as claimed in claim 1, wherein said vent parts define an outer edge extending parallel to, but offset from, said vent opening, said movable member defining an attachment portion extending longitudinally along the other edge of the movable member, and fasteners securing said attachment portion to said roof along said outer edge of a corresponding vent part.

17. Ventilating device as claimed in claim 16, wherein a reinforcing strip extends along said attachment portion, said fasteners extending through said reinforcing strip.

18. A ventilating device for a roof having a longitudinally extending ridge member supported by transversely spaced inclined rafters, a vent opening extending substantially parallel to said ridge board, said ventilating device including a cap for said vent opening, said cap extending along said vent opening substantially parallel to said ridge member and including a pair of longitudinally extending vent parts extending along said vent opening substantially parallel to said ridge member each of said vent parts being mounted on said roof on opposite sides of said vent opening and having an upper surface extending substantially parallel to said roof, said vent parts defining a plurality of vent passages for communicating the vent opening to ambient atmosphere, and an elongated, longitudinally extending, a movable member extending along said vent parts substantially parallel to the vent opening, said movable member being movable from an inactive position permitting communication through said passages to an active position closing said vent passages to prevent entry of wind driven moisture into said vent opening, one edge of said movable member terminating in a longitudinally extending compressible bubble extending along said one edge parallel to said vent opening, said bubble being compressed against said vent part when the ambient wind speed is above a predetermined wind speed.

19. Ventilating device as claimed in claim 18, wherein said bubble is a turned over edge portion extending from a main body portion of said movable member, said turned over portion being secured to the main body portion to form said bubble.

20. Ventilating device as claimed in claim 18, wherein said movable member is a spun-bonded olefin sheet of high density polyethylene fibers.

21. Ventilating device as claimed in claim 18, wherein said movable member includes a loop defining a compartment there within, said bubble extending from one end of the loop.

22. Ventilating device as claimed in claim 21, wherein said loop and said bubble defines an active portion of said movable member which moves between said active and inactive positions, said active portion extending between opposite ends of said loop, and an inactive portion of said movable member extending from the other end of said loop.

23. Ventilating device as claimed in claim 22, wherein a baffle is installed in said compartment to weight said loop to the inactive position, whereby wind at a speed in excess of the predetermined speed is necessary to maintain the loop in the active position.

24. Ventilating device as claimed in claim 18, wherein each of said vent parts include a sheet of material folded to define compartments supported on said roof, said compartments extending parallel to said vent opening, said material having, perforations defining said vent passages, said movable member being a baffle within one of said compartments and extending longitudinally therein, said baffle in the active position closing said passages and having a pair of opposite longitudinally extending edges, said bubble extending along one of said edges and engaging said sheet material when the baffle is in the active position.

25. Ventilating device as claimed in claim 24, wherein a second bubble extends along the other edge of said baffle.

26. Ventilating device as claimed in claim 18, wherein said vent parts define an outer edge extending parallel to, but offset from, said vent opening, said movable member defining an attachment portion extending longitudinally along the other edge of the movable member, and fasteners securing said attachment portion to said roof along said outer edge of a corresponding vent part.

27. Ventilating device as claimed in claim 26, wherein a reinforcing strip extends along said attachment portion, said fasteners extending through said reinforcing strip.

28. Ventilating device as claimed in claim 18, wherein said movable member is hingedly connected to said roof and includes an arm engaging said ridge board when the movable member is in the active position, said bubble extending along said arm and being compressed against said ridge board when the movable member is in the active position.

29. In a building having an opening and a member at least partially closing said opening, a weatherstripping strip mounted on said building along said opening and having an elongated movable portion terminating in a longitudinally extending deflectable bubble, said movable portion and said bubble being responsive to ambient wind speed in excess of a predetermined wind speed to deflect said bubble against said member to thereby restrain entry of wind driven moisture into said building through said opening.

30. The combination as claimed in claim 29, wherein said opening is a vent opening in the roof of said building and said member is a ventilating device including a pair of vent parts extending along opposite sides of said opening, said vent parts defining passages extending between an inner edge of the corresponding vent part along said vent opening and an opposite outer edge, said weatherstripping strip extending along said outer edge, said movable portion being responsive to ambient wind to move toward said corresponding vent part, said bubble being compressed against said corresponding vent part in response to ambient wind.

31. The combination of claim 29, wherein said opening is a door or window opening in said building and said member is a door or window, said weatherstripping strip being mounted on said building around said opening, said bubble being compressed against the corresponding door or window in said opening.

32. A weatherstripping device for a roof having a longitudinally extending ridge, with vent parts extending along said ridge having vent openings communicating with an interior space of the roof for ventilation purposes, the weatherstripping device comprising a longitudinally extending mounting strip for mounting adjacent to said vent openings, and a movable and flexible cover strip secured to said mounting strip, said cover strip being movable from a position remote from said vent openings to a position covering said vent openings, in response to the wind velocity against said cover strip.

* * * * *